US008727823B2

(12) United States Patent
Fletcher et al.

(10) Patent No.: US 8,727,823 B2
(45) Date of Patent: May 20, 2014

(54) WATER JET PROPULSION DEVICE

(75) Inventors: Paul Fletcher, Rugby (GB); Paul J. Newton, Derby (GB); John R. Webster, Derby (GB)

(73) Assignee: Rolls-Royce PLC, London (GB)

( * ) Notice: Subject to any disclaimer, the term of this patent is extended or adjusted under 35 U.S.C. 154(b) by 84 days.

(21) Appl. No.: 13/418,924

(22) Filed: Mar. 13, 2012

(65) Prior Publication Data

US 2012/0252287 A1 Oct. 4, 2012

(30) Foreign Application Priority Data

Apr. 1, 2011 (GB) ..... 1105555.5

(51) Int. Cl.
*B63H 11/103* (2006.01)

(52) U.S. Cl.
USPC ..... 440/47; 440/40

(58) Field of Classification Search
USPC ..... 440/38, 44, 45, 47, 40, 48; 60/204, 221
See application file for complete search history.

(56) References Cited

U.S. PATENT DOCUMENTS 3,808,804 A 5/1974 Scott-Scott
5,244,425 A * 9/1993 Tasaki et al. ..... 440/47

FOREIGN PATENT DOCUMENTS

DE 25 24 913 A1 12/1976
GB 2 344 331 A 6/2000
GB 2 344 332 A 6/2000
WO WO 01/79060 A1 10/2001

OTHER PUBLICATIONS

May 24, 2011 Search Report issued in British Application No. 1105555.5.
Jul. 4, 2012 European Search Report issued in European Patent Application No. 12159189.

* cited by examiner

*Primary Examiner* — Lars A Olson
(74) *Attorney, Agent, or Firm* — Oliff PLC

(57) ABSTRACT

There is provided a water jet propulsion device 10 for a water vehicle, comprising a main duct 12 having a main inlet 14 that is arranged to be submerged in use and a main outlet 16; a pump disposed between the main inlet 14 and the main outlet 16; and a plurality of injection nozzles 40, 50, 60, 70 each arranged to selectively eject a jet of fluid into a different region A, B, C, D susceptible to cavitation, so as to re-energise the fluid flow in that region.

17 Claims, 4 Drawing Sheets

WATER JET PROPULSION DEVICE

The invention relates to a water jet propulsion device for a water vehicle such as a boat.

Water jet propulsion devices are often used to power water vehicles such as boats. They are also sometimes known as pump-jets or hydro-jets. Water jet propulsion devices typically comprise a pump having an inlet that is submerged in use and an outlet that is generally located above the water level. In use, the pump ejects a jet of water rearwards out of the outlet which provides a propulsive force to the boat to drive it forwards.

Figure 1:
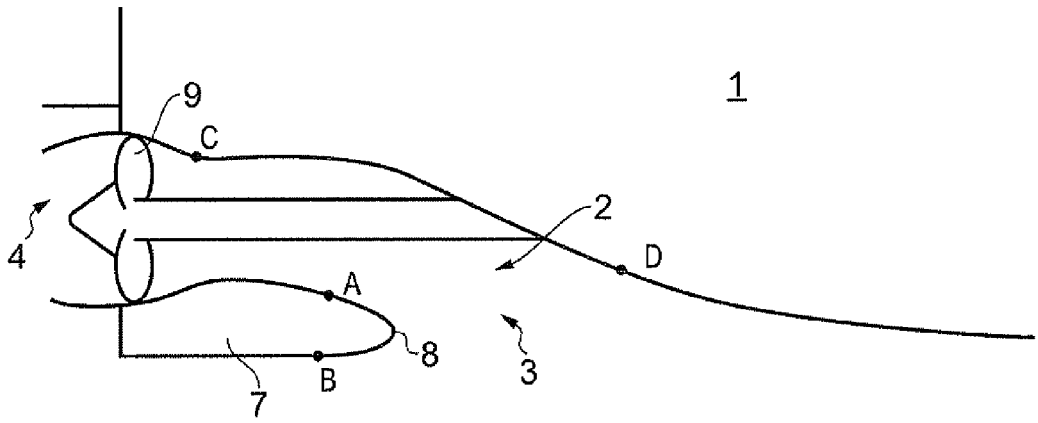
FIG. 1 (Prior Art)

A previously considered water jet propulsion device 1 is shown in FIG. 1. The propulsion device 1 comprises a duct 2 having an inlet 3 and an outlet 4. The duct 2 defines a duct lip 7 which has a forward-facing edge 8. A ducted impeller 9 is disposed in the duct 2 and is driven by a motor.

When the boat is travelling at low-speed, the pump sucks water in through the inlet 3. For optimum performance it is desirable to have a relatively large inlet throat area so that the necessary volume of water can be sucked through the inlet 3 by the pump. However, when the boat is travelling at high-speed, water is forced into the inlet 3 due to the speed of the boat. This usually results in too much water being forced into the inlet 3 and therefore it is desirable to have a smaller inlet 3. The dimensions and design of the inlet 3 and duct 2 are therefore a compromise for both low-speed and high-speed operation.

However, the inlet 3 is usually still too small for low-speed operation and too large for high-speed operation. This can result in separation and cavitation occurring at various positions around the inlet at both low-speed and high-speed operation. Flow separation reduces the effective intake area and therefore the thrust capability of the propulsion device 1. Cavitation is undesirable since it creates pressure pulses which impact the impeller which may cause excessive noise, erosion and potential damage.

When the water jet propulsion device 1 operates at low speed, water is drawn from behind the inlet 2 and is turned around the duct lip 7 into the main duct 2. This can lead to flow separation at A which is a position on the upper surface of the duct lip 7 rearward of the edge 8. In turn, this flow separation can lead to cavitation if the pressure of the liquid falls below its vapour pressure and gas bubbles form.

When a conventional water jet propulsion device 1 operates at high speed, excess water can flow into the duct 2, leaving an absence and hence cavitation at B which is a position on the lower surface of the lip 7 towards the edge 8. Furthermore, flow separation can occur at C which is a position upstream of the impeller 9 close to the upper wall of the duct 2, and at D which is a position on the rearwardly-inclined upper wall of the duct 2 towards the inlet 2. The flow separation and cavitation can lead to excessive drag, low efficiency of the water jet propulsion device and damage to the pump.

It is therefore desirable to provide a water jet propulsion device having an improved water inlet design.

In a broad aspect the invention concerns an injection nozzle for ejecting a jet of water into a region susceptible to cavitation in order to re-energise the boundary layer. This may help to prevent separation and cavitation and hence may avoid the associated disadvantages.

According to an aspect of the invention there is provided a water jet propulsion device for a water vehicle, such as a boat, comprising: a main duct having a main inlet that is arranged to be submerged in use and a main outlet; a pump disposed between the main inlet and the main outlet; and a plurality of injection nozzles each arranged to selectively eject a jet of fluid into a different region susceptible to cavitation, so as to re-energise the fluid flow in that region.

In use, the pump accelerates water within the main duct and ejects a jet of water out of the main outlet to propel the water vehicle. Typically, at low speeds water is sucked into the main duct through the main inlet by the pump and at high speeds water is forced into the main duct through the main inlet due to the speed of the water vehicle. The pump may comprise an impeller disposed in the main duct. The impeller may be driven by a drive shaft coupled to a motor. The drive shaft may be angled or horizontal. The impeller may be rim-driven.

The water jet propulsion device may be integrally part of a water vehicle or may be a separate device that can be attached to a water vehicle.

The regions susceptible to cavitation may be regions susceptible to low pressure where separation may occur. At least some of the regions may be susceptible to cavitation at low boat speed, for example at speeds less than 20 knots, and at least some of the regions may be susceptible to cavitation at high boat speed, for example at speeds greater than 20 knots. The regions may be within the main duct or in the region of the main duct. The plurality of injection nozzles may be arranged to eject a jet of water. The jet of water may re-energise the fluid flow boundary layer, which may be a water flow, in the region where cavitation/separation may tend to occur, thereby preventing or inhibiting cavitation. At least one of the plurality of injection nozzles may eject a jet of fluid at high-speed operation and at least one of the plurality of injection nozzles may eject a jet of fluid at low-speed operation.

The main duct may comprise an upper wall and an injection nozzle may be arranged to selectively eject a jet of fluid into a region close to and upstream of the pump and close to the upper wall. This may prevent cavitation in this region at high speed. Therefore, the injection nozzle may eject a jet of fluid at high-speed operation.

The main duct may have a rearwardly-inclined duct portion having an upper inclined wall. The main duct may also include a substantially horizontal duct portion. An impeller may be disposed within the horizontal duct portion. An injection nozzle may be arranged to selectively eject a jet of fluid into a region close to the upper inclined wall and the main inlet. This may prevent cavitation in this region at high speed. Therefore, the injection nozzle may eject a jet of fluid at high speed operation.

The inclined duct portion may define a duct lip having an upper lip surface within the main duct, a lower lip surface and a forward-facing lip edge forming part of the main inlet. An injection nozzle may be arranged to selectively eject a jet of fluid into a region close to the upper lip surface and the main inlet. This may prevent cavitation in this region at low speed. Therefore, the injection nozzle may eject a jet of fluid at low speed operation. An injection nozzle may be arranged to selectively eject a jet of fluid into a region close to the lower lip surface and the main inlet. This may prevent cavitation in this region at high speed. Therefore, the injection nozzle may eject a jet of fluid at high speed operation.

The injection nozzle may be an opening in the respective wall. The nozzle may be a slot, for example. A nozzle body may project from the respective wall or may extend through the wall. Some or all of the injection nozzles may comprise an inclined portion inclined in the flow, or downstream, direction.

The respective wall may comprise a curved surface disposed downstream of each injection nozzle. Each of the plurality of injection nozzles may be arranged to eject a jet of fluid in the downstream direction. The jet of fluid may be ejected in the same direction as the general fluid flow.

At least some of the plurality of injection nozzles may be moveable between at least a non-deployed position when the injection nozzle is not in use and a deployed position when the injection nozzle is ejecting a jet of fluid. In other words, when a jet of water is to be ejected from a particular injection nozzle it may be moved to the deployed position. Some or all of the injection nozzles may be moveable. Some or all of the injection nozzles may be hingedly moveable or may be able to flex between the non-deployed and the deployed position.

At least some of the injection nozzles may be in fluid communication with an injector line having an inlet downstream of the pump. Each injection nozzle may be in fluid communication with a separate injector line having an inlet downstream of the pump. There may be a single injector line inlet that supplies more than one injection nozzle. In this arrangement a separate pump arrangement for supplying the injection nozzles may not be required. Each injection nozzle may be provided with a valve which can be selectively opened or closed in order to control the ejection of a jet of fluid from the injection nozzle. An auxiliary pump may be provided for supplying fluid to at least one, or all, of the injection nozzles. Again, each injection nozzle may be provided with a valve such that the ejection of a jet of fluid from the nozzle can be controlled.

The water jet propulsion device may further comprise control means arranged to selectively control the ejection of a jet of fluid from each of the plurality of injection nozzles. The control means may be connected to valves associated with each injection nozzle so as to selectively control the ejection of a jet of fluid from each of the nozzles. The water jet propulsion device may further comprise at least one sensor arranged to measure at least one parameter, wherein the at least one sensor is connected to the controller which is arranged to automatically control each of the plurality of injection nozzles based on the at least one measured parameter. The parameter may be shaft speed, pressure, differential pressure, or boat speed, for example. In alternative arrangements the injection nozzles may be manually controlled.

The invention also concerns a water vehicle, such as a boat or ship, comprising a water jet propulsion device in accordance with any statement herein.

The invention may comprise any combination of the features and/or limitations referred to herein, except combinations of such features as are mutually exclusive.

Figure 2:
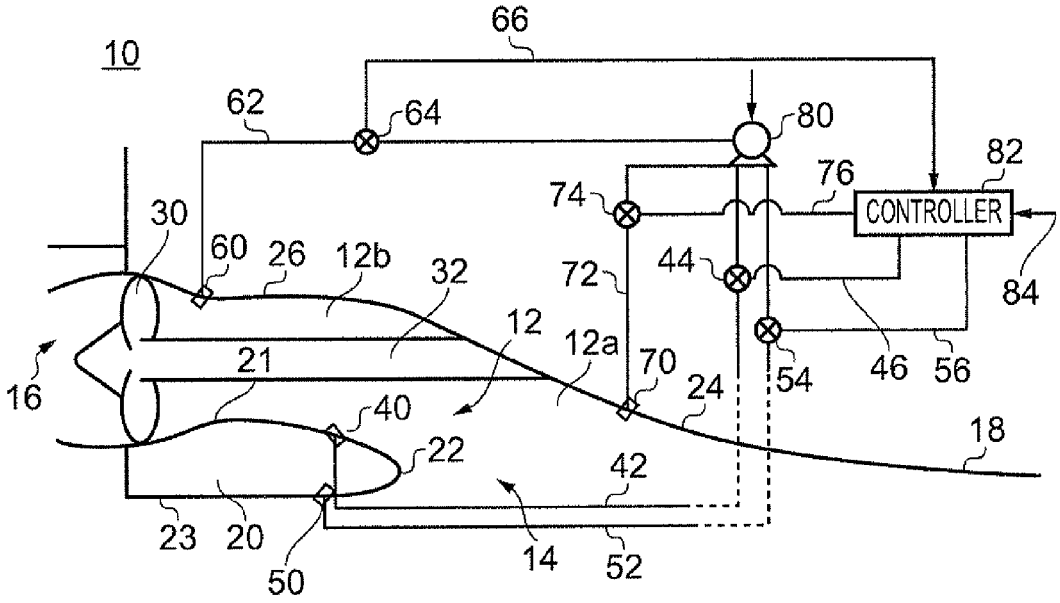
Figure 3:
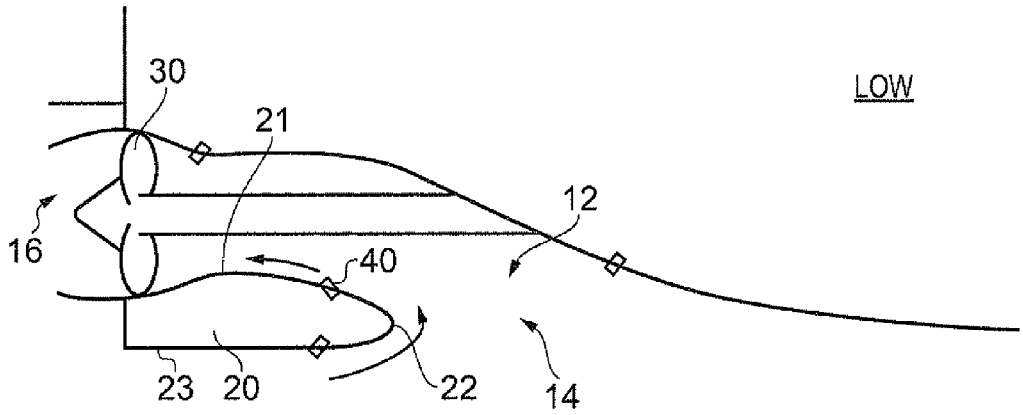
Figure 4:
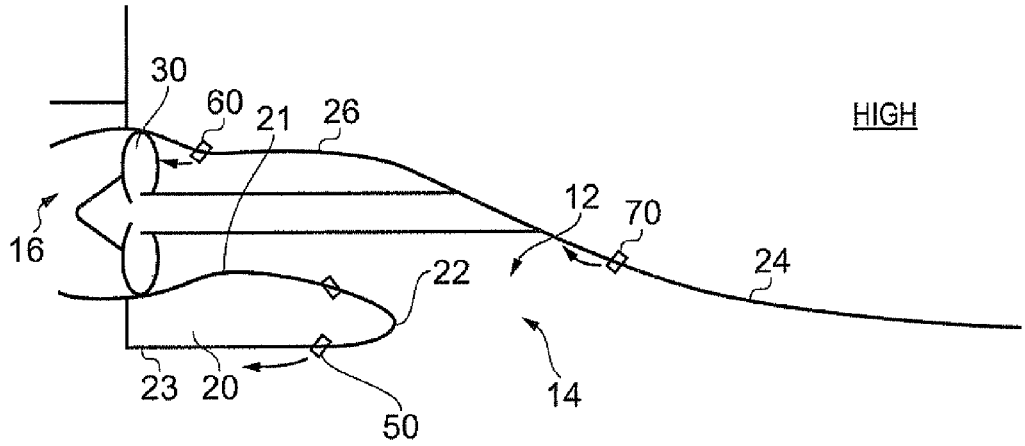
Figure 5:
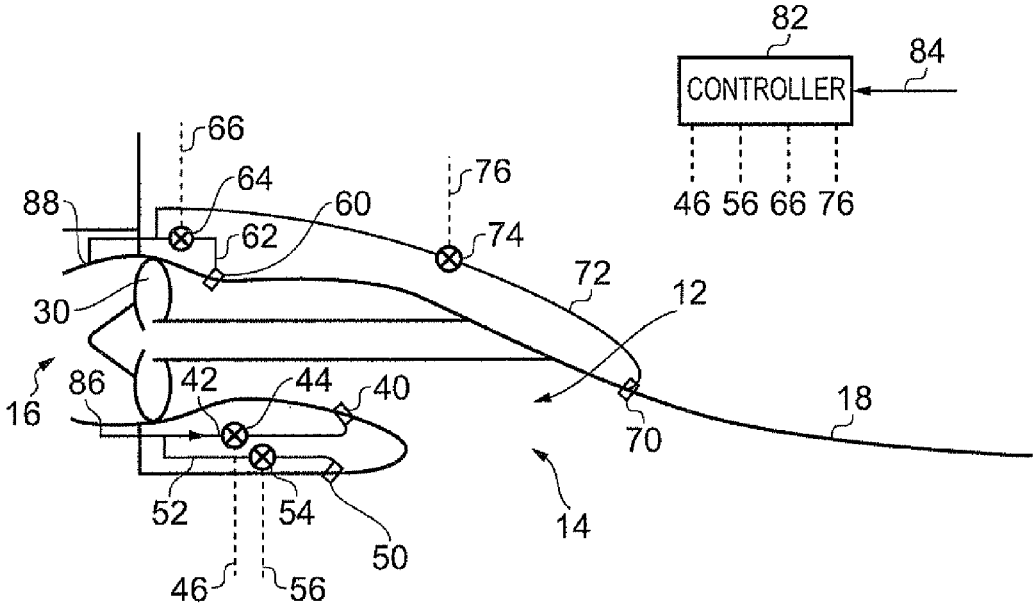
Figure 6:
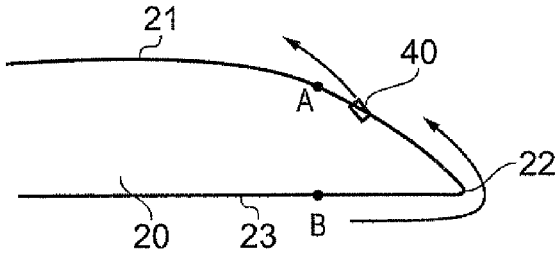

Embodiments of the invention will now be described, by way of example only, with reference to the accompanying drawings, in which:

FIG. 1 schematically shows a previously considered water et propulsion device;

FIG. 2 schematically shows a water jet propulsion device according to a first embodiment of the invention;

FIG. 3 schematically shows the water jet propulsion device of FIG. 2 operating at low-speed;

FIG. 4 schematically shows the water jet propulsion device of FIG. 2 operating at high-speed;

FIG. 5 schematically shows a water jet propulsion device according to a second embodiment of the invention;

FIG. 6 schematically shows an alternative lip design; and

Figure 7:
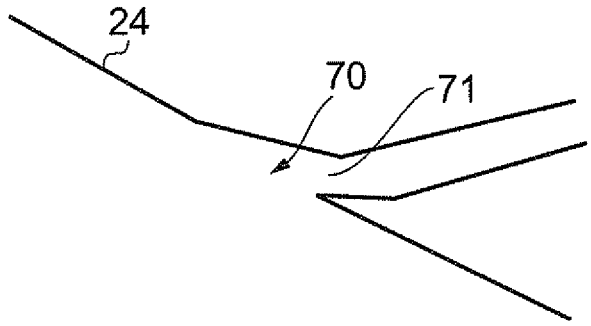
Figure 8:
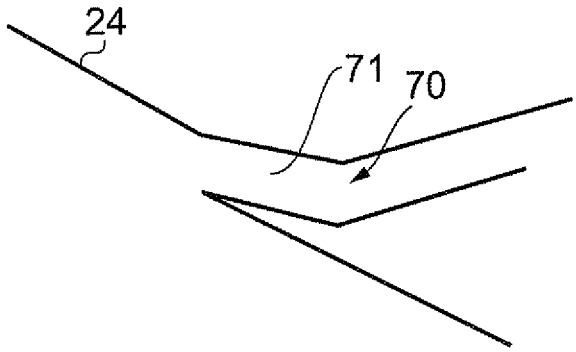
Figure 9:
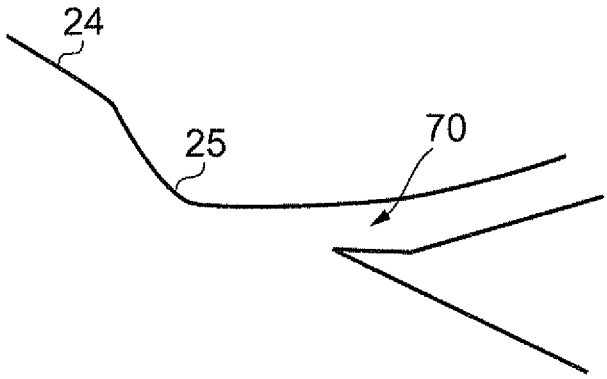

FIGS. 7-9 schematically shows alternative injection nozzle designs.

FIG. 2 shows an embodiment of a water jet propulsion device 10 which is integrally part of a water vehicle which in this embodiment is a boat. It should be appreciated that in other embodiments the water jet propulsion device 10 could be a separate device arranged to be attached to a water vehicle. The propulsion device 10 comprises a main duct 12 having a main inlet 14 and a main outlet 16. The main inlet 14 lies in a substantially horizontal plane and is formed in the lower surface of the hull 18 of the boat. In use, the main inlet 14 is submerged underwater. The main outlet 16 lies in a substantially vertical plane and is formed in a side surface of the hull 18 of the boat. In use, the main outlet 16 is located above the water line. A nozzle (not shown) may constitute or form part of the main outlet.

The main duct 12 comprises an inclined portion 12*a* and a substantially horizontal portion 12*b*. The inclined duct portion 12*a* extends from the main inlet 14 rearwards (downstream) and upwards and transitions into the horizontal portion 12*b* that extends rearwards to the main outlet 16. The inclined portion 12*a* of the main duct 12 comprises a rearwardly-inclined upper wall 24 that transitions into an upper wall 26 that forms part of the horizontal portion 12*b*. In other embodiments the main duct 12 may be entirely inclined along its length. The main duct 12 defines a main duct lip 20 having an upper surface 21, a lower surface 23 which forms part of the hull 18 and a forward-facing lip edge 22 which is also part of the edge of the main inlet 14. The upper surface 21 of the lip 20 forms part of the main duct 12.

The water jet propulsion device further comprises a pump having a ducted impeller 30 which is disposed in the horizontal portion 12*b* of the main duct 12. The impeller 30 is mounted to a substantially horizontal rotational drive shaft 32 that passes through the upper wall of the main duct 12 into the interior of the boat. The drive shaft 32 is coupled to a motor (not shown) which is arranged to rotationally drive the drive shaft 32 and hence the impeller 30 about a horizontal axis.

The water jet propulsion device also comprises four injection nozzles 40, 50, 60, 70. The injection nozzles 40, 50, 60, 70 are formed in a wall, or surface, of the main duct 12 or the duct lip 20 and are arranged to eject a jet of water. Each injection nozzle 40, 50, 60, 70 is disposed in a position or region susceptible to low pressure and hence separation and cavitation. A first nozzle 40 is located at A which is a position on the upper surface 21 of the lip 20 towards the main inlet 14. A second nozzle 50 is located at B which is a position on the lower surface 23 of the lip towards the main inlet 14. A third nozzle 60 is located at C which is a position on the upper wall 26 downstream of and close to the impeller 30. A fourth nozzle 70 is located at D which is a position on the rearwardly-inclined upper wall 24 towards the main inlet 14. Separation and cavitation tend to occur in these positions in a conventional water jet, as discussed with respect to FIG. 1. At low speed cavitation tends to occur at A, where as at high speed cavitation tends to occur at B, C and D.

Each of the injection nozzles 40, 50, 60, 70 are arranged to selectively eject a jet of water in the downstream direction in order to re-energise the fluid flow in that region. In this embodiment an auxiliary pump 80 is provided which supplies high-pressure water to each of the injection nozzles through a respective injection line 42, 52, 62, 72. Each injection line 42, 52, 62, 72 is provided with an individual solenoid valve 44, 54, 64, 74 which are connected to a common controller 82 by a respective control line 46, 56, 66, 76. The controller 82 is provided with a control input through a control input line 84.

In use, the hull 18 of the boat is partially submerged in water so that the main inlet 14 is submerged. The impeller 30 is rotated about a horizontal axis by the drive shaft 32 and water in the main duct 12 is accelerated by the impeller 30 and forced out of the main outlet 16 as a jet of water which causes the boat to be propelled forwards. The speed of the impeller 30 can be increased or decreased in order to increase or decrease the propulsive force generated by the water jet propulsion device 10.

With reference to FIG. 3, if the boat is operating at low speed, which may be considered to be less than 20 knots, the first injection nozzle 40 is turned on by sending a control signal to the first solenoid valve 44. Turning on the first injection nozzle 40 causes a jet of water to be ejected from the first nozzle 40 in the downstream direction towards the impeller 30. The jet of water is ejected in a direction substantially parallel to the upper surface 21 of the duct lip 20. The jet of water ejected by the first nozzle 40 re-energises the water flow in that region which may have low energy due to flow turning around the lip 22. Re-energising the fluid flow in this region therefore prevents separation and hence cavitation from occurring.

With reference to FIG. 4, if the boat is operating at high speed, which may be considered to be greater than 20 knots, the first injection nozzle 40 is turned off, and the second, third and fourth injection nozzles 50, 60, 70 are turned on by sending an appropriate control signal to the respective solenoid valves 54, 64, 74. This causes the second, third and fourth injection nozzles 50, 60, 70 to eject a jet of water in the downstream direction. Specifically, the second injection nozzle 50 ejects a jet of water along the lower surface 23 of the lip 23, the third injection nozzle 60 ejects a jet of water along the upper wall 26 of the duct 12, and the fourth injection nozzle 70 ejects a jet of water along the rearwardly-inclined wall 24 of the main duct. The jets of water are ejected in a direction substantially parallel to the direction of the wall or surface. The jets of water ejected by the nozzles 50, 60, 70 re-energise the water flow in the said regions which may have low energy or be at a low pressure due to the high speed operation. Re-energising the fluid flow in these regions therefore prevents separation and hence cavitation from occurring.

The use of injection nozzles 40, 50, 60, 70 that can selectively eject jets of water can avoid separation, cavitation and pump face distortion at both low and high speeds. This may extend the operating range of the device, providing improved thrust capability at low and high speeds whilst avoiding damage and low efficiency performance. The use of injection nozzles 40, 50, 60, 70 may also improve the acceleration capability of the propulsion device and may result in improved efficiency at both low and high speed.

Further, the use of injection nozzles to avoid cavitation may mean that the inlet is less of a compromise between high speed and low speed operation. This may allow other areas of the intake to be redesigned to improve the performance at high or low speed.

Although it has been described that at low speed the first injection nozzle 40 is turned on and the other injection nozzles are turned off, and at high speed the second, third and fourth injection nozzles 50, 60, 70 are turned on and the first injection nozzle 40 is turned off, it will be appreciated that other modes of operation may be possible. For example, only one injection nozzle may be turned on at high speed, or two, or four.

The control line 84 to the controller 82 which controls the operation of the solenoid valves 44, 54, 64, 70 associated with the injection nozzles may be coupled to a manual control. For example, an operator may decide which injection nozzles to turn on and off. In another embodiment the control line 84 is connected to sensors (not shown) that may measure or detect various parameters such as boat speed, pressure levels at a particular point, differential pressure, impeller speed or shaft power, for example. The controller 82 could be programmed to turn on or off a particular combination of injection nozzles based on the detected or measured parameters in order to optimise the power and efficiency of the water jet propulsion device. For example, if the controller 82 detects that the boat is operating at low speed based on the measured shaft speed, it may automatically turn on the first injection nozzle 40 at A in order to prevent cavitation at A. If the controller 82 detects that the boat is operating at high speed based on the measured shaft speed, it may automatically turn on the second, third and fourth injection nozzles 50, 60, 70.

It may be desirable to operate one or more of the injection nozzles 40, 50, 60, 70 during acceleration where a potential loss of efficiency could be tolerated. For example, the first injection nozzle 40 could be operated to eject a jet of water into region A during acceleration only.

Using the third injection nozzle 60 at position C may increase the top speed of the water jet propulsion device by providing a more uniform flow to the impeller 30.

One of the key benefits of certain embodiments of the invention is that no moving parts are required that could be subject to damage from debris. The injection nozzles may be disposed in positions such that they are protected by the main duct, for example. This results in the design being particularly robust. Also, the ability to control the flow in certain regions of the main duct may allow for the geometry of the duct to be optimised for particular operating conditions.

FIG. 5 shows a second embodiment of a water jet propulsion device 10 which is similar to the first embodiment. The main difference between the embodiments is that there is no auxiliary pump 80 for supplying high-pressure water to the injection nozzles 40, 50, 60, 70. Instead, there are first and second injection intakes 86, 88 located downstream of the impeller. The first intake 86 supplies high pressure water generated by the impeller 30 to the first injection nozzle 40 and the second injection nozzle 50 through the injection lines 44, 54. The first and second injection nozzles 40, 50 can be controlled in the same way as described for the first embodiment by the solenoid valves 42, 52 connected to the controller 82. The second intake 88 supplies high pressure water generated by the impeller 30 to the third injection nozzle 60 and the fourth injection nozzle 70 through the injection lines 62, 72. The third and fourth injection nozzles 60, 70 can be controlled in the same way as described for the first embodiment by the solenoid valves 64, 74 connected to the controller 82. The injection intakes 86, 88 may be provided with a scoop (not shown) in order to direct pressurised fluid flow into the injection lines.

In use, the injection nozzles 40, 50, 60, 70 are selectively turned on or off in order to eject a jet of water in the downstream direction in order to re-energise the fluid flow in that region. This can help to prevent separation and cavitation which is undesirable. Using the high-pressure water generated by the impeller 30 for the injection nozzles 40, 50, 60, 70 means that a separate auxiliary pump is not required. This may reduce the overall weight of the device.

The use of injection nozzles 40, 50, 60, 70 to prevent or inhibit separation and cavitation may allow other areas of the intake to be optimised for a particular operating condition. For example, as shown in FIG. 6, if a first injection nozzle 40 is used to prevent separation that may be caused at A during low-speed operation due to turning around the lip 20, the lip 20 can be optimised for high-speed operation. Thus, the lower surface 23 of the lip 22 can be substantially horizontal which at high speed may prevent separation occurring at B.

Various types of injection nozzle 40, 50, 60, 70 can be used. The injection nozzle may simply be an opening in the wall or surface of the main duct 12 or lip 20. This opening may be a slot having a maximum dimension in a direction perpendicular to the flow direction. Alternatively, the injection nozzle may be a circular or oval opening. In other embodiments a separate nozzle piece, which may be angled downstream, may pass through an opening in the wall or surface. The nozzle piece could potentially be moveable between a deployed configuration when it is ejecting a jet or water and a non-deployed configuration when it is not operational. The nozzle piece could be hingedly attached or could be flexible.

FIG. 7 shows an injection nozzle design that can be used for the fourth injection nozzle 70. It will be appreciated that a similar nozzle design could be used for the other injection nozzles. As can be seen, the injection nozzle 70 comprises an angled portion 71 that is angled downstream and in the direction of the rearwardly-inclined wall 24. This would have the effect of directing the jet to the region close to the wall where separation may occur at high-speed.

FIG. 8 shows an injection nozzle design that is similar to the injection nozzle of FIG. 7. However, the angled portion 71 is angled more towards the wall 24 than the angled portion 71 of FIG. 7. This would improve the effectiveness of directing the jet towards the wall 24 to prevent or inhibit cavitation.

FIG. 9 shows an arrangement for the fourth injection nozzle 70 in which a curved portion 25 is formed in the inclined wall 24 downstream of the nozzle 70. In use, the injection nozzle 70 would eject a jet of water parallel to the surface of the curved portion 25 and the jet would follow the curvature of the curved portion by virtue of the Coandă effect. The ejected jet of water would therefore follow the curved portion 25 to the region susceptible to cavitation.

Although it has been described that there are four injection nozzles, it will be appreciated by one skilled in the art that any suitable number may be used in order to control cavitation and separation at particular positions. Further, injection nozzles may be provided at other positions not described and arranged so that they inject a jet of fluid to re-energise flow in that region so as to prevent or control separation and cavitation.

The invention claimed is:

1. A water jet propulsion device for a water vehicle, comprising:

a main duct having a main inlet that is arranged to be submerged in use and a main outlet;

a pump disposed between the main inlet and the main outlet; and a plurality of injection nozzles, each nozzle being arranged to selectively eject a jet of fluid into different respective regions susceptible to cavitation, so as to re-energise a fluid flow in each respective region.

2. A water jet propulsion device according to claim 1, wherein the main duct comprises an upper wall and wherein an injection nozzle is arranged to selectively eject a jet of fluid into a region close to and upstream of the pump and close to the upper wall.

3. A water jet propulsion device according to claim 1, wherein the main duct has a rearwardly-inclined duct portion having an upper inclined wall.

4. A water jet propulsion device according to claim 3, wherein an injection nozzle is arranged to selectively eject a jet of fluid into a region close to the upper inclined wall and the main inlet.

5. A water jet propulsion device according to claim 3, wherein the inclined duct portion defines a duct lip having an upper lip surface within the main duct, a lower lip surface and a forward-facing lip edge forming part of the main inlet.

6. A water jet propulsion device according to claim 5, wherein an injection nozzle is arranged to selectively eject a jet of fluid into a region close to the upper lip surface and the main inlet.

7. A water jet propulsion device according to claim 5, wherein an injection nozzle is arranged to selectively eject a jet of fluid into a region close to the lower lip surface and the main inlet.

8. A water jet propulsion device according to claim 2, wherein the injection nozzle is an opening in the respective wall.

9. A water jet propulsion device according to claim 1, wherein the respective wall comprises a curved surface disposed downstream of each injection nozzle.

10. A water jet propulsion device according to claim 1, wherein each of the plurality of injection nozzles is arranged to eject a jet of fluid in the downstream direction.

11. A water jet propulsion device according to claim 1, wherein at least some of the plurality of injection nozzles are moveable between at least a non-deployed position when the injection nozzle is not in use and a deployed position when the injection nozzle is ejecting a jet of fluid.

12. A water jet propulsion device according to claim 1, wherein at least some of the injection nozzles are in fluid communication with an injector line having an inlet downstream of the pump.

13. A water jet propulsion device according to claim 1, further comprising control means arranged to selectively control the ejection of a jet of fluid from each of the plurality of injection nozzles.

14. A water jet propulsion device according to claim 13, further comprising at least one sensor arranged to measure at least one parameter, wherein the at least one sensor is connected to the controller which is arranged to automatically control each of the plurality of injection nozzles based on the at least one measured parameter.

15. A water jet propulsion device for a water vehicle, comprising:

a main duct having a main inlet that is arranged to be submerged in use and a main outlet;

a pump disposed between the main inlet and the main outlet; and a plurality of injection nozzles each arranged to selectively eject a jet of fluid into a different region susceptible to cavitation, so as to re-energise a fluid flow in that region, wherein at least some of the plurality of injection nozzles are moveable between at least a non-deployed position when the injection nozzle is not in use and a deployed position when the injection nozzle is ejecting a jet of fluid.

16. A water jet propulsion device for a water vehicle, comprising:

a main duct having a main inlet that is arranged to be submerged in use and a main outlet;

a pump disposed between the main inlet and the main outlet;

a plurality of injection nozzles each arranged to selectively eject a jet of fluid into a different region susceptible to cavitation, so as to re-energise a fluid flow in that region; and control means arranged to selectively control the ejection of a jet of fluid from each of the plurality of injection nozzles.

17. A water jet propulsion device according to claim 16, further comprising at least one sensor arranged to measure at least one parameter, wherein the at least one sensor is connected to the controller which is arranged to automatically control each of the plurality of injection nozzles based on the at least one measured parameter.

* * * * *